US006115952A

United States Patent [19]

Rigler

[11] Patent Number: 6,115,952

[45] Date of Patent: Sep. 12, 2000

[54] APPARATUS FOR MOUNTING ACCESSORIES TO FIREARMS

[75] Inventor: Joseph W. Rigler, Rolla, Mo.

[73] Assignee: R7BAR, L.L.C., Rolla, Mo.

[21] Appl. No.: 09/062,049

[22] Filed: Apr. 17, 1998

[51] Int. Cl.[7] ..... F41G 1/36

[52] U.S. Cl. ..... 42/103; 362/110

[58] Field of Search ..... 42/101, 103, 86; 362/110, 113, 114; 33/245, 246, 247, 248, 249, 250

[56] References Cited

U.S. PATENT DOCUMENTS

| | | | |
|---|---|---|---|
| 924,445 | 6/1909 | Foss . | |
| 1,002,115 | 8/1911 | Barnes | 42/86 |
| 1,144,656 | 6/1915 | Hise et al. . | |
| 1,456,440 | 5/1923 | Hise . | |
| 2,425,130 | 8/1947 | Shelley | 42/101 |
| 2,526,126 | 10/1950 | Gagnier | 33/249 |
| 2,597,565 | 5/1952 | Chandler et al. . | |
| 2,653,386 | 9/1953 | Winton | 42/101 |
| 2,717,447 | 9/1955 | Leupold | 42/101 |
| 3,106,348 | 10/1963 | Robinson . | |
| 3,513,581 | 5/1970 | Slater . | |
| 3,750,318 | 8/1973 | Burris | 42/101 |
| 4,212,109 | 7/1980 | Snyder | 33/241 |
| 4,494,328 | 1/1985 | Stevens | 42/103 |
| 4,571,870 | 2/1986 | Heideman et al. | 42/103 |
| 5,042,186 | 8/1991 | Bechtel | 42/103 |
| 5,531,039 | 7/1996 | Gore | 33/245 |
| 5,669,173 | 9/1997 | Rodney, Jr. | 42/103 |
| 5,727,346 | 3/1998 | Lazzarini et al. | 42/103 |

FOREIGN PATENT DOCUMENTS

| | | | |
|---|---|---|---|
| 71238 | 9/1915 | Austria | 42/86 |

*Primary Examiner*—Stephen M. Johnson
*Attorney, Agent, or Firm*—Howell & Haferkamp, LC

[57] ABSTRACT

A mounting apparatus for mounting accessories to firearms comprises an accessory lug, a frame, and an accessory lug fixture. The accessory lug is fixed to the firearm. The accessory lug has a lug cross-section shaped to prevent the accessory lug from being received within a standard bayonet lug fixture. The frame includes an accessory-holding portion adapted for holding the accessory and an accessory lug fixture connected to the frame. The accessory lug fixture has a lug-receiving channel with a channel cross-section. The channel cross-section is different than a cross-section of a standard bayonet lug. The channel cross-section is shaped to permit the channel to receive either the accessory lug or a standard bayonet lug in a manner for securing the frame and the accessory to the firearm. In another aspect of the present invention, an apparatus for mounting a flashlight to a firearm comprises a frame mountable to the firearm, a first flashlight-retaining member connected to the frame, and a second flashlight-retaining member connected to the frame and spaced from the first flashlight-retaining member. The second flashlight-retaining member is moveable relative to the first flashlight-retaining member between first and second positions. The second flashlight-retaining member is connected to the frame by a resilient member, which permits movement of the second flashlight-retaining member between its first and second positions. The resilient member biases the second flashlight-retaining member toward its second position. The first and second flashlight-retaining members are adapted for permitting engagement and disengagement of the flashlight with the first and second flashlight-retaining members when the second flashlight-retaining member is in its first position and for securing the flashlight relative to the frame when the second flashlight-retaining member is in its second position.

16 Claims, 4 Drawing Sheets

APPARATUS FOR MOUNTING ACCESSORIES TO FIREARMS

BACKGROUND OF THE INVENTION

This invention relates generally to accessories for firearms and, more particularly, to apparatus for efficiently mounting accessories to firearms.

The general concept of attaching accessories to firearms is known. For many years, the military, law enforcement authorities and others who use firearms have been mounting edged weapons, such as a dagger-like blade or knife, onto firearms for use primarily as an alternative or "back-up" weapon that can be used in hand-to-hand confrontations. These alternative weapons are commonly referred to as "bayonets." Typically, a bayonet is removably attachable to the muzzle end of a firearm by a bayonet mount of some kind. Most of these bayonet mounts are of the "quick-detach" type, and many of the designs have remained unchanged since the First World War.

A typical bayonet mount is basically comprised of two components: a male component usually referred to as a "bayonet lug," and a female component usually referred to as a "bayonet lug fixture." Usually, the lug is fixed to the firearm, usually on or near the barrel of the firearm, and the lug fixture is fixed to the bayonet, usually at the end of the hilt of the knife. The lug fixture typically has a channel or recess of some kind sized to receive the lug therein for securing the bayonet to the firearm. Usually, the lug has a generally "dove-tailed" shape and the channel in the lug fixture has a matching female shape. The lug fixture usually has a locking mechanism of some kind that allows the lug fixture to "snap" over the lug, to keep the bayonet from falling off of the firearm. Typically, the locking mechanism is a spring-biased mechanism, such as a detent mechanism. This quick detachability allows the user to use the bayonet as a normal knife, and to then simply "snap" it on to the firearm as needed. Usually, the bayonet also includes a front mount near the blade guard of the knife. The front mount typically includes a hole bored slightly larger in diameter than the muzzle brake of the firearm to which the bayonet is to be mounted. The front mount simply fits over the muzzle brake when the bayonet is mounted to the firearm to provide further securement.

The manufacture and use of bayonet mounts is regulated by Chapter 44 of Title 18 of the United States Code, as modified by the Violent Crime Control and Law Enforcement Act of 1994. Pertinent portions of this Act were enacted on Sep. 13, 1994. One aspect of the Act provides that, with certain exceptions, it is a violation of the Act to manufacture a firearm having a "bayonet lug" (as defined in 18 U.S.C. Section 921) after the enactment date, or to add or retro-fit a "bayonet lug" to a firearm manufactured after the enactment date. The Act does not prohibit the use of such weapons by the military or law enforcement authorities. This provision of the Act has no retroactive effect and does not prohibit the use of "bayonet lugs" on firearms manufactured prior to the enactment date.

The general concept of mounting a light, such as a flashlight, to a firearm is also known. Doing so allows the user to project light in the same direction that the firearm is aimed without having to independently hold and aim the flashlight. This allows targets to be quickly identified and engaged in the dark without expensive night vision devices.

In the prior art, this has been accomplished in a number of ways. Commonly, a flashlight is mounted to a firearm using a plurality of bands or ring clamps. The flashlight is connected to the ring clamps, which are then clamped to the barrel of the firearm. Another prior art flashlight mounting mechanism involves "screwing" the flashlight into a threaded bore in the fore-end of the firearm. A problem with these prior art mounting mechanisms is that they are cumbersome, and inevitably require the use of tools, such as wrenches and screw drivers. Consequently, mounting a flashlight may take a number of minutes and cannot be easily done in the dark. If, instead, the flashlight is left permanently mounted to the firearm, normal use of the flashlight is not possible. A permanent mount is also not desirable because, in daytime conditions when the flashlight is not needed, the firearm is made unnecessarily heavier and more awkward. Another problem with some clamp-type flashlight mounts is that they may block or otherwise interfere with the firearm's aiming sights, preventing the sights from being properly used for aiming the firearm.

SUMMARY OF THE INVENTION

It is an object of the present invention to provide an efficient mechanism for mounting accessories to firearms. Another object is to provide a mounting apparatus for removably mounting a flashlight to firearms which allows the flashlight to be quickly attached to and detached from the firearm without tools, thus allowing the flashlight to be used for multiple purposes. Still another object is to provide a mounting apparatus for mounting a flashlight to a firearm "bayonet-style." Yet another object is to provide a mounting apparatus having a lug shaped to be receivable within a correspondingly shaped lug fixture, but not receivable within a standard bayonet lug fixture, so that said mounting apparatus does not qualify as a "bayonet mount" under 18 U.S.C. Section 921, and so that said mounting apparatus does not violate Chapter 44 of Title 18 of the United States Code, as modified by the Violent Crime Control and Law Enforcement Act of 1994. Still another object is to provide a mounting apparatus having a lug fixture shaped to receive either a correspondingly shaped lug or a standard bayonet lug.

In general, an apparatus for attaching a flashlight to a firearm comprises a lug and a frame. The lug is mounted to the firearm. The frame has a flashlight-holding portion and a lug fixture. The flashlight-holding portion is adapted for holding the flashlight. The lug fixture has a lug-receiving channel adapted to receive the lug in a manner for securing the frame and the flashlight to the firearm.

In another aspect of the invention, a firearm includes a bayonet-style lug. The apparatus comprises a frame substantially as described above with a lug fixture connected to the frame. The lug fixture has a lug-receiving channel adapted to receive the bayonet-style lug of the firearm in a manner for securing the frame and the flashlight to the firearm.

In still another aspect of the invention, a bayonet-style mounting apparatus for attaching an accessory to a firearm comprises an accessory lug, a frame, and an accessory lug fixture. The accessory lug is mounted to the firearm. The accessory lug has a lug cross-section shaped to prevent the accessory lug from being received within a standard bayonet lug fixture. The frame includes an accessory-holding portion adapted for holding the accessory and an accessory lug fixture connected to the frame. The accessory lug fixture has a lug-receiving channel with a channel cross-section. The channel cross-section is different than a cross-section of a standard bayonet lug. The channel cross-section is shaped to permit the lug-receiving channel to receive either the accessory lug or a standard bayonet lug in a manner for securing the frame and the accessory to the firearm.

In yet another aspect of the present invention, an apparatus for mounting a flashlight to a firearm comprises a frame mountable to a firearm, a first flashlight-retaining member, and a second flashlight-retaining member. The first flashlight-retaining member is connected to the frame, and at least a portion of the first flashlight-retaining member lies in a first plane. The second flashlight-retaining member is spaced from the first flashlight-retaining member, and at least a portion of the second flashlight-retaining member lies in a second plane. The second flashlight-retaining member is moveable relative to the first flashlight-retaining member between first and second positions. The first and second planes are substantially parallel with one another when the second flashlight-retaining member is in its first position, and are non-parallel when the second flashlight-retaining member is in its second position. The second flashlight-retaining member is connected to the frame by a resilient member, which permits movement of the second flashlight-retaining member between its first and second positions. The resilient member biases the second flashlight-retaining member toward its second position. The first and second flashlight-retaining members are adapted for permitting engagement and disengagement of the flashlight with the first and second flashlight-retaining members when the second flashlight-retaining member is in its first position. The first and second flashlight-retaining members are adapted for securing the flashlight relative to the first and second flashlight-retaining members when the second flashlight-retaining member is in its second position.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
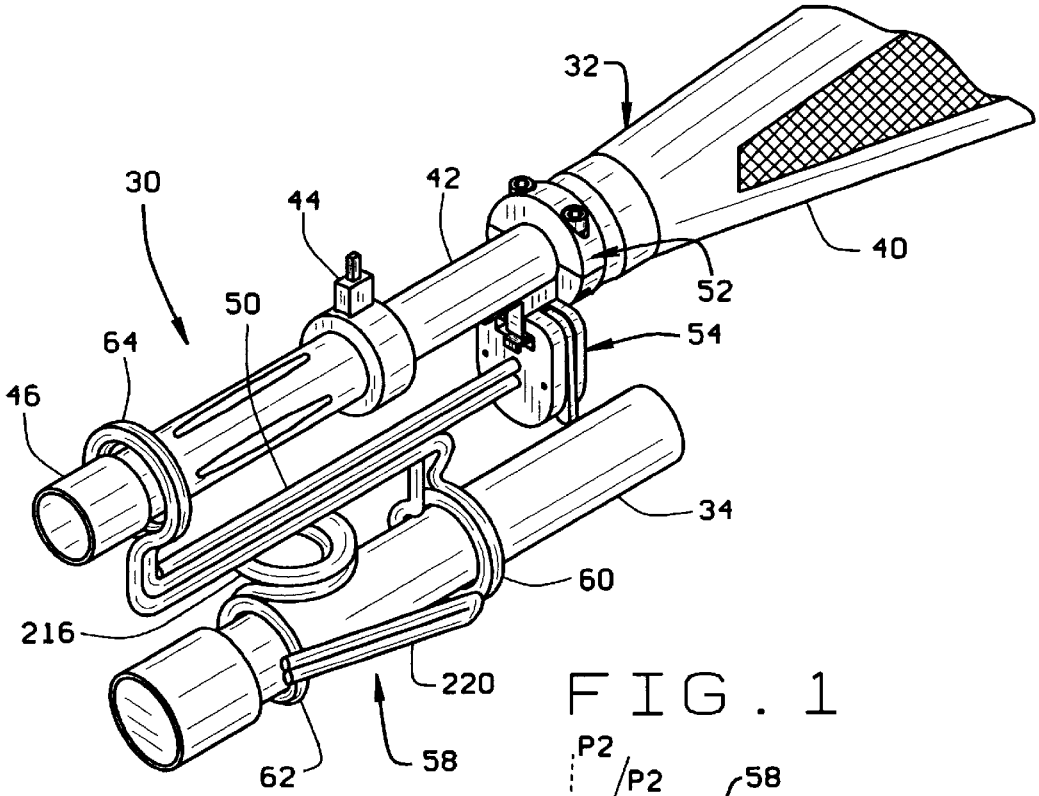
FIG. 1 is a perspective view of a mounting apparatus of the present invention shown with a flashlight, the mounting apparatus being mounted to a firearm.

A mounting apparatus of the present invention is represented generally in FIG. 1 by the reference numeral 30. FIG. 1 is a perspective view of the mounting apparatus 30 mounted to a firearm 32 and shown with a flashlight 34. The particular firearm shown in FIG. 1 has a stock 40, a barrel 42, an aiming sight 44, and a muzzle brake 46, although other types of firearms may be used with the present invention. Preferably, the mounting apparatus 30 of the present invention includes a frame 50 and a lug fixture 54 connected to the frame, with a lug 52 mounted to the firearm 32.

The frame 50 includes a clamping mechanism 58 and a barrel-receiving fixture 64. The clamping mechanism 58 includes a first flashlight-retaining member 60 and a second flashlight-retaining member 62. The second flashlight-retaining member 62 is spaced from the first flashlight-retaining member 60. Preferably, each of the first and second flashlight-retaining members 60 and 62 has a portion that is configured to at least partially circumscribe a typical flashlight having a generally cylindrical housing. The barrel-receiving fixture 64 is located at a forward portion of the frame 50 and includes a hole that is slightly larger in diameter than the muzzle brake 46 of the firearm 32 to which the frame 50 is mounted. The barrel-receiving fixture 64 simply fits over the muzzle brake 46 when the frame 50 is mounted to the firearm 32. In other types of firearms having no muzzle brake, the barrel-receiving fixture 64 fits over the distal end (muzzle) of the barrel 42. The structure and operation of the clamping mechanism 58 will be described in greater detail hereinafter.

Figure 7:
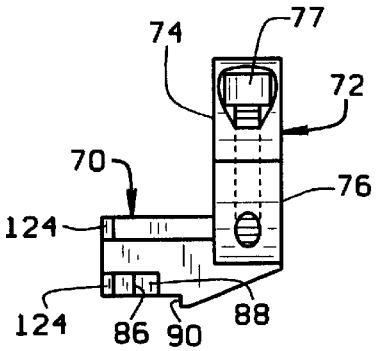
FIG. 7 is a side elevational view of a standard bayonet lug, which is known in the art.
Figure 8:
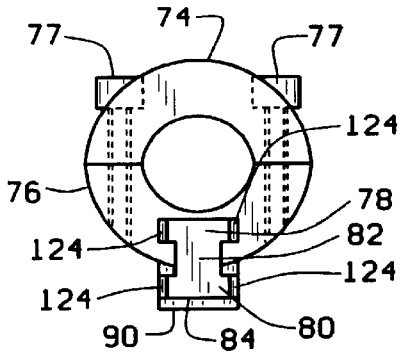
FIG. 8 is an end elevational view of the standard bayonet lug of FIG. 7.

A standard bayonet lug is represented in FIGS. 7 and 8 by the reference numeral 70. The standard bayonet lug 70 is known in the art and has been used for years as part of a standard bayonet mounting system for mounting a bayonet to a firearm. The particular lug represented in FIGS. 7 and 8 is a standard COLT M-7 bayonet lug. The standard lug 70 is connected to a standard lug collar 72. The standard lug collar 72 includes a generally semi-circular upper collar portion 74 and a generally semi-circular lower collar portion 76. The standard lug 70 shown in FIGS. 7 and 8 is integral with the lower collar portion 76. The upper and lower collar portions 74 and 76 are configured for circumscribing the barrel 42 of the firearm 32. Adjustment screws 77 are provided for adjusting the relative positions of the upper and lower collar portions 74 and 76 to accommodate barrels of different diameters. Standard bayonet lugs are mounted to firearms in other ways as well, and some are even integrally formed with the barrel or another part of the firearm.

As shown in FIG. 8, the standard lug 70 has a generally "I" shaped cross-section defined by a generally horizontal upper lug portion 78, a generally horizontal lower lug portion 80, and a generally vertical middle lug portion 82 connecting the upper and lower lug portions 78 and 80. A bottom surface 84 of the lower lug portion 80 is substantially flat. As shown in FIG. 7, the lower lug portion 80 of the standard lug 70 includes a shoulder 86 facing the lug collar 72. The shoulder 86 defines a lateral recess 88 in the lower lug portion 80. The lower lug portion 80 includes an identical lateral recess on the opposite side (not shown) of the lower lug portion 80. The standard lug 70 also includes a downwardly extending ridge 90, the purpose of which will be described below.

Figure 9:
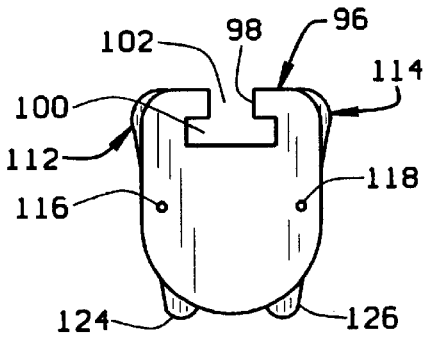
FIG. 9 is an end elevational view of a standard bayonet lug fixture, which is known in the art, the standard lug fixture being shown in a lug-receiving condition.
Figure 10:
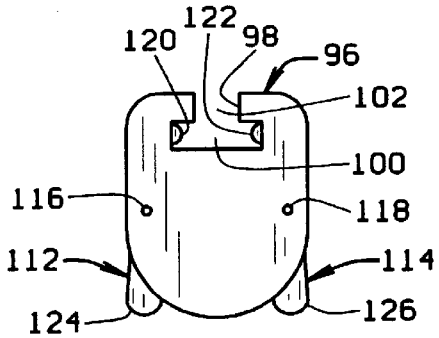
FIG. 10 is an end elevational view of the standard bayonet lug fixture of FIG. 9, the standard lug fixture being shown in a lug retaining condition.
Figure 16:
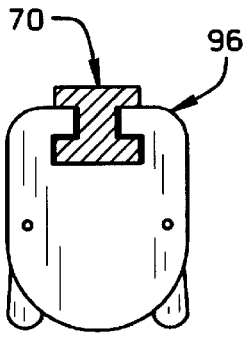
FIG. 16 is an end elevational view of the standard bayonet lug fixture of FIG. 9 shown in a lug retaining condition, and shown with the standard bayonet lug of FIG. 7 received and retained therein, the standard bayonet lug being represented in partial cross section.

A standard bayonet lug fixture is represented generally in FIGS. 9 and 10 by the reference numeral 96. The standard bayonet lug fixture 96 is known in the art and has been used for years as part of a standard bayonet mounting system for mounting a bayonet to a firearm. Typically, the standard bayonet lug fixture 96 is connected to a bayonet (not shown) at the hilt end of the knife. The standard fixture 96 has a channel 98 sized to receive the standard bayonet lug 70 therein for securing the bayonet to a firearm. As shown in FIGS. 9 and 10, the channel 98 has a generally inverted-T shaped cross-section defined by a generally horizontal lower channel portion 100 and a generally vertical channel portion 102. The generally inverted-T shaped cross section of the channel 98 matches the lower half of the generally "I" shaped cross-section of the standard lug 70 so that the lower half of the standard lug 70 can be received within the channel 98. FIG. 16 is an end elevational view of the standard bayonet lug fixture 96 shown with the standard lug 70 (represented in partial cross section) received and retained therein.

The standard lug fixture 96 includes a locking mechanism comprised of a first spring biased lever 112 and a second spring biased lever 114. The first and second levers 112 and 114 are pivotable relative to the channel 98 about pivot pins 116 and 118. Each of the first and second levers 112 and 114 is pivotable between a first position (shown in FIG. 10) and a second position (shown in FIG. 9). The first and second levers 112 and 114 include inwardly directed lateral projections 120 and 122 at their upper ends, and finger engageable portions 124 and 126 at their lower ends for manual operation of the levers between their first and second positions. The lateral projections 120 and 122 project at least partially into the lower channel portion 100 of the channel 98 when the levers 112 and 114 are in the first position, and are moved laterally out of the lower channel portion 100 when the levers 112 and 114 are in the second position. The levers are biased by springs (not shown) toward the first position.

As shown in FIGS. 7 and 8, the distal end of the standard lug 70 includes chamfers 124 to facilitate insertion of the standard lug 70 into the channel 98. The chamfers 124 also permit a user to "snap" the standard lug fixture 96 over the standard lug 70 without the need to manually move the levers 112 and 114 from their first position to their second position. The lateral projections 120 and 122 ride along the chamfers 124 to the lateral edges of the lower lug portion 80 as the standard lug 70 is inserted into the channel 98. Once the standard lug 70 is inserted far enough into the channel 98 so that the lateral recesses 88 are in register with the lateral projections 120 and 122, the lateral projections will "snap" into the recesses 88 to hold the standard lug 70 within the channel 98. The downwardly extending ridge 90 of the standard lug 70 is adapted to butt up against the body of the standard lug fixture 96 to prevent the standard lug 70 from being inserted too far into the channel 98.

Figure 6:
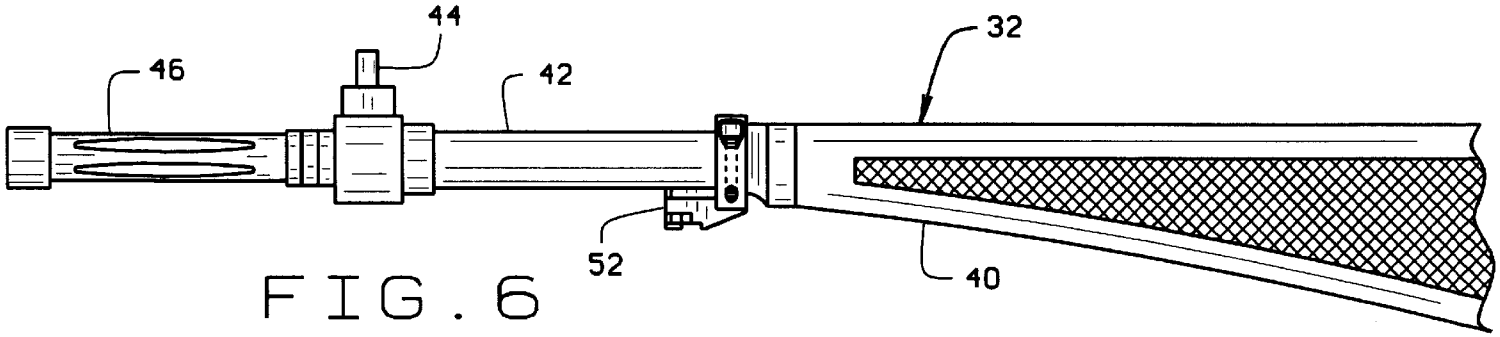
FIG. 6 is a side elevational view of a lug of the present invention, shown with a firearm to which the lug is mounted.
Figure 11:
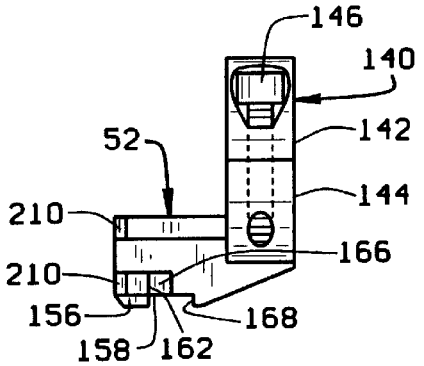
FIG. 11 is a side elevational view of the lug of FIG. 6.
Figure 12:
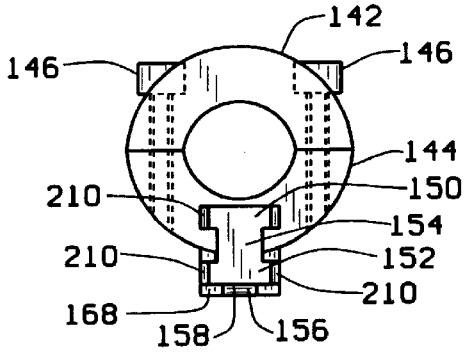
FIG. 12 is an end elevational view of the lug of FIG. 6.
Figure 13:
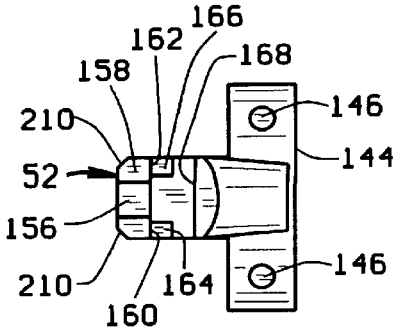
FIG. 13 is a bottom plan view of the lug of FIG. 6.

A lug 52 of the present invention is shown in FIGS. 6 and 11–13. The lug 52 is connected to a lug collar 140. The lug collar 140 is similar to the standard lug collar 72 discussed above and includes an generally semi-circular upper collar portion 142 and a generally semi-circular lower collar portion 144. As best shown in FIGS. 11 and 13, the lug 52 is preferably integral with the lower collar portion 144. As shown in FIG. 6, the upper and lower collar portions 142 and 144 are configured for circumscribing the barrel 42 of the firearm 32. Adjustment screws 146 are provided for adjusting the relative positions of the upper and lower collar portions 142 and 144 to tighten the upper and lower collar portions 142 and 144 around the barrel 42 and to accommodate barrels of different diameters. It should be understood that the lug 52 could be mounted or connected to a firearm in other ways without departing from the scope of the present invention. For example, the lug 52 could be integral with the barrel 42 of the firearm.

As shown in FIG. 12, the lug 52 preferably has a unique cross-section that differs from the standard lug 70 described above. Preferably, the lug cross-section is defined by a generally horizontal upper lug portion 150, a generally horizontal lower lug portion 152, a generally vertical middle lug portion 154 connecting the upper and lower lug portions 150 and 152, and a projection 156 extending downwardly from a bottom surface 158 of the lower lug portion 152. The projection 156 is a key difference between the lug 52 of the present invention and the standard lug 70 described above. As shown in FIGS. 11 and 13, the lower lug portion 152 of the lug 52 preferably includes shoulders 160 and 162 facing the lug collar 140. The shoulders 160 and 162 define lateral recesses 164 and 166 in the lower lug portion 152. Preferably, the lug 52 also includes a downwardly extending ridge 168 adjacent the lug collar 140.

Figure 2:
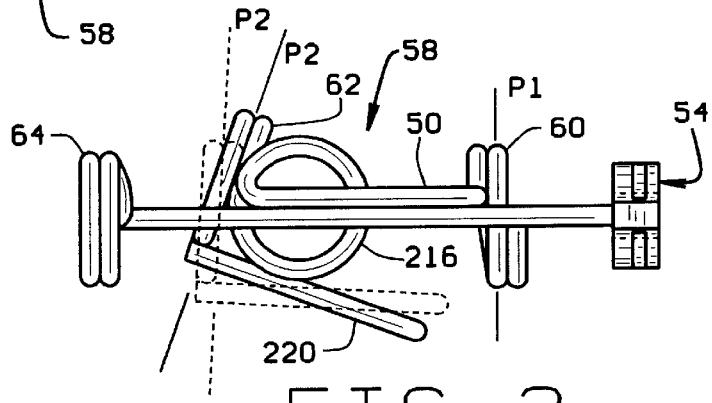
FIG. 2 is a top plan view of the mounting apparatus of FIG. 1, showing a first position of a flashlight-retaining member of the apparatus in dashed lines and showing a second position of the flashlight-retaining member in solid lines.
Figure 3:
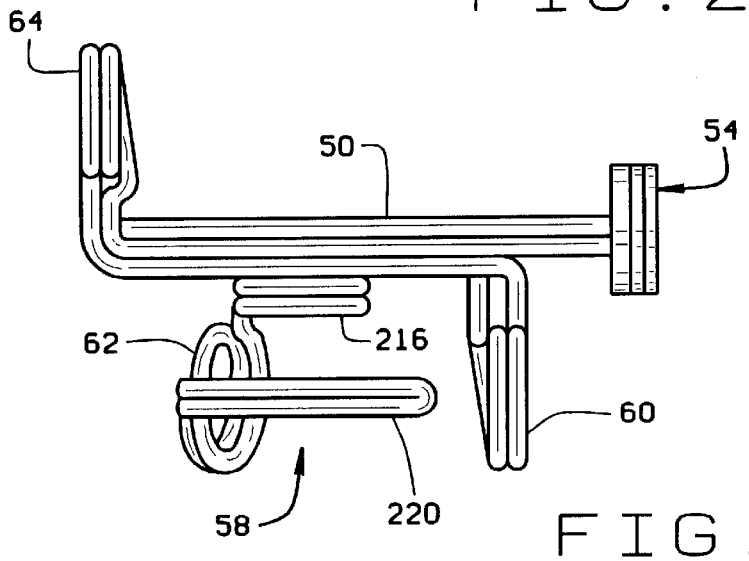
FIG. 3 is a side elevational view of the apparatus of FIG. 1.
Figure 14:
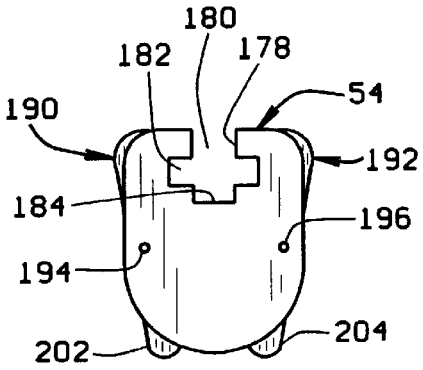
FIG. 14 is an end elevational view of a lug fixture of the present invention, the lug fixture being shown in a lug-receiving condition.
Figure 15:
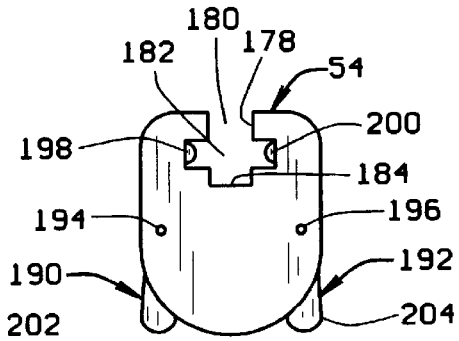
FIG. 15 is an end elevational view of the lug fixture of FIG. 14, the lug fixture being shown in a lug retaining condition.

The lug fixture of the present invention is represented generally in FIGS. 14 and 15 by the reference numeral 54. As shown in FIGS. 1–3, the lug fixture 54 is connected to the frame 50. Preferably, the lug fixture 54 is rigidly connected to the frame 50 and, more preferably, the lug fixture 54 is integral with the frame 50. The lug fixture 54 has a channel 178 sized to receive the lug 52 therein for securing the frame 50 to the firearm 32. As shown in FIGS. 14 and 15, the channel 178 preferably has a unique cross-section that matches the cross-section of the lug 52, and that differs from the standard lug fixture 96 described above. Preferably, the cross-section of the channel 178 is defined by a generally vertical channel portion 180, a generally horizontal lower channel portion 182, and a sub-channel 184 in communication with the lower channel portion 182. The generally vertical channel portion 180 and the generally horizontal lower channel portion 182 form an inverted-T shape. As shown in FIGS. 14 and 15, the sub-channel 184 is preferably located extending downwardly from the inverted-T shape and in communication with the lower channel portion 182 and generally in line with the vertical channel portion 180 that form the inverted-T shape.

Figure 17:
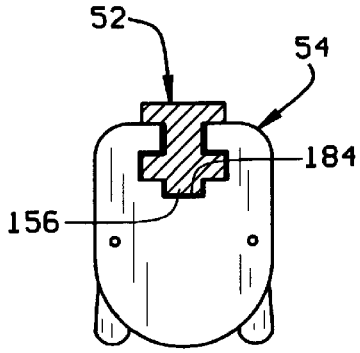
FIG. 17 is an end elevational view of the lug fixture of FIG. 14 shown in a lug retaining condition, and shown with the lug of FIG. 6 received and retained therein, the lug being represented in partial cross section.

The generally horizontal lower lug portion 152 and the generally vertical middle lug portion 154 also form an inverted-T shape. As shown in FIG. 12, the projection 156 extends downwardly from the lower lug portion 152 and is generally in line with vertical middle lug portion 154. Thus, the cross-section of the channel 178 matches the lower portion of the cross-section of the lug 52 so that the lower portion of the lug 52 can be received within the channel 178. FIG. 17 is an end elevational view of the lug fixture 54 shown with the lug 52 (represented in partial cross section) received and retained therein.

Preferably, the lug fixture 54 includes a locking mechanism similar in structure and function to the locking mechanism of the standard bayonet lug fixture 96 described above. As shown in FIGS. 14 and 15, the locking mechanism of the lug fixture 54 preferably comprises a first spring biased lever 190 and a second spring biased lever 192. The first and second levers 190 and 192 are preferably pivotable relative to the channel 178 about pivot pins 194 and 196. Each of the first and second levers 190 and 192 is pivotable between a first position (shown in FIG. 15) and a second position (shown in FIG. 14). The first and second levers 190 and 192 preferably include inwardly directed lateral projections 198 and 200 at their upper ends, and finger engageable portions 202 and 204 at their lower ends for manual operation of the levers between their first and second positions. Preferably, the lateral projections 198 and 200 project at least partially into the lower channel portion 182 of the channel 178 when the levers 190 and 192 are in the first position, and are moved laterally out of the lower channel portion 182 when the levers 190 and 192 are in the second position. The levers are preferably biased by springs (not shown) toward the first position.

As shown in FIGS. 11–13, the distal end of the lug 52 preferably includes chamfers 210 to facilitate insertion of the lug 52 into the channel 178. The chamfers 210 also permit a user to "snap" the lug fixture 54 over the lug 52 without the need to manually move the levers 190 and 192 from their first position to their second position. The lateral projections 198 and 200 ride outwardly along the chamfers 210 to the lateral edges of the lower lug portion 152 as the lug 52 is inserted into the channel 178. Once the lug 52 is inserted far enough into the channel 178 so that the lateral recesses 164 and 166 are in register with the lateral projections 198 and 200, the projections will "snap" into the recesses 164 and 166 to hold the lug 52 within the channel 178. The downwardly extending ridge 168 of the lug 52 is adapted to butt up against the body of the lug fixture 54 to prevent the lug 52 from being inserted too far into the channel 178.

Figure 18:
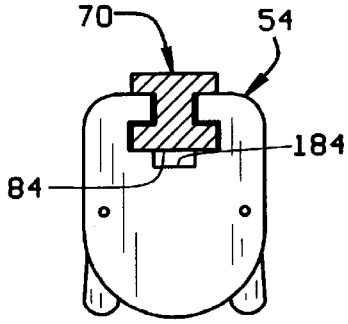
FIG. 18 is an end elevational view of the lug fixture of FIG. 14 shown in a lug retaining condition, and shown with the standard bayonet lug of FIG. 7 received and retained therein, the standard bayonet lug being represented in partial cross section.

The unique cross-section of the channel 178 of the lug fixture 54 permits the lug fixture to receive either the lug 52 of the present invention or a standard bayonet lug 70 in a manner for securing the frame 50 to the firearm. FIG. 18 is an end elevational view of the lug fixture 54 shown with the standard bayonet lug 70 (represented in partial cross section) received and retained therein. Although the lug fixture 54 of the present invention can accept a standard bayonet lug 70, the reverse is not true. The standard bayonet lug fixture 96 cannot accept the lug 52 of the present invention. Preferably, the unique shape of the cross-section of the lug 52, and particularly the projection 156 which extends downwardly from the lower lug portion 152, prevents the lug 52 from being received within a standard bayonet lug fixture 96. The sub-channel 184 of the lug fixture 54 of the present invention is configured to accommodate the projection 156. Thus, the lug fixture 54 of the present invention is adapted to receive either the lug 52 of the present invention or a standard bayonet lug 70, but the lug 52 of the present invention is not receivable in a standard bayonet lug fixture 96. Although the projection 156 in the preferred embodiment has been shown and described as extending downwardly from the bottom surface 158 of the lower lug portion 152, and although the sub-channel 184 has been shown and described as being in communication with the lower channel portion 182 and generally in line with the vertical channel portion 180, it should be understood that the projection 156 could be positioned elsewhere on the lug 52, and the sub-channel 184 could be positioned elsewhere in the channel 178, to serve the same functions without departing from the scope of the present invention.

The frame 50 shown in FIGS. 1–3 is an "under-mount" frame adapted for holding a flashlight 34 or other firearm accessory, e.g., a laser aiming sight, under the barrel 42. The frame 50 includes a unique clamping mechanism 58 for holding the flashlight 34 or other accessory. Preferably, the clamping mechanism 58 includes a first flashlight-retaining member 60 and a second flashlight-retaining member 62 spaced from the first flashlight-retaining member 60. As shown in FIGS. 1–3, each of the first and second flashlight-retaining members 60 and 62 is configured to circumscribe a flashlight 34 or other accessory. The retaining members shown have a circular shape. However, the retaining members could have other shapes, such as a general U-shape, or each could have a different shape and still function in the intended manner to be described. The particular size and shape of the retaining members will depend on the flashlight or other accessory to be held by the retaining members. Preferably, the size and shape of the retaining members will be such that the clamping mechanism holds the flashlight with the flashlight's beam directed down the line of sight of the firearm. Also, the spacing between the first and second flashlight-retaining members 60 and 62 will depend on the flashlight or other accessory to be held by the retaining members, and could be separated by distance other than that shown in the drawings without departing from the scope of the present invention.

Preferably, the first flashlight-retaining member 60 is fixed relative to the frame 50. At least a portion of the first flashlight-retaining member 60 lies in a first plane P1. At least a portion of the second flashlight-retaining member 62 lies in a second plane P2. Preferably, the second flashlight-retaining member 62 is moveable relative to the first flashlight-retaining member 60 and relative to the frame 50 between a first position (shown in dashed lines in FIG. 2) and a second position (shown in solid lines in FIG. 2). As shown in FIG. 2, the first plane P1 and the second plane P2 are substantially parallel with one another when the second flashlight-retaining member 62 is in its first position. The first and second planes P1 and P2 are non-parallel when the second flashlight-retaining member 62 is in its second position.

The second flashlight-retaining member 62 is preferably connected to the frame 50 by a resilient member 216 that permits movement of the second flashlight-retaining member 62 between its first and second positions. Preferably, the resilient member 216 biases the second flashlight-retaining member 62 toward its second position. As shown in FIGS. 1–3, the resilient member 216 is preferably a coil spring, although the resilient member 216 could have other configurations that permit movement of the second flashlight-retaining member 62 relative to the first flashlight-retaining member 60 and relative to the frame 50 while biasing the second flashlight-retaining member 62 back toward its second position. Preferably, the clamping mechanism 58 also includes a lever 220 operatively connected to the second flashlight-retaining member 62 to assist the user in manually moving the second flashlight-retaining member 62 from its second position toward its first position against the spring bias.

The first and second flashlight-retaining members 60 and 62 are adapted for permitting engagement and disengagement of the flashlight 34 with the first and second flashlight-retaining members 60 and 62 when the second flashlight-retaining member 62 is in its first position. As best illustrated in FIG. 2, the first and second flashlight-retaining members 60 and 62 are generally in line with one another when the second flashlight-retaining member 62 is in its first position. Thus, when the second flashlight-retaining member 62 is in its first position, the flashlight 34 can be easily inserted through the first and second flashlight-retaining members 60 and 62, or removed therefrom in a similar manner.

The first and second flashlight-retaining members 60 and 62 are adapted for securing the flashlight 34 relative to the first and second flashlight-retaining members 60 and 62 and relative to the frame 50 when the second flashlight-retaining member 62 is biased toward its second position. As best illustrated in FIG. 2, the first and second flashlight-retaining members 60 and 62 are offset relative to one another when the second flashlight-retaining member 62 is in its second position. Thus, when the second flashlight-retaining member 62 is biased toward its second position, the flashlight 34 is securely held by the first and second flashlight-retaining members 60 and 62.

Figure 4:
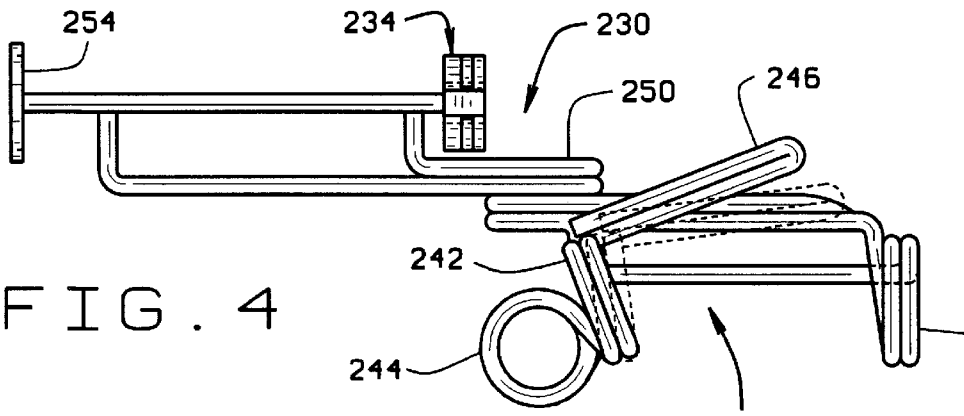
FIG. 4 is a top plan view of an alternative embodiment of a mounting apparatus of the present invention.
Figure 5:
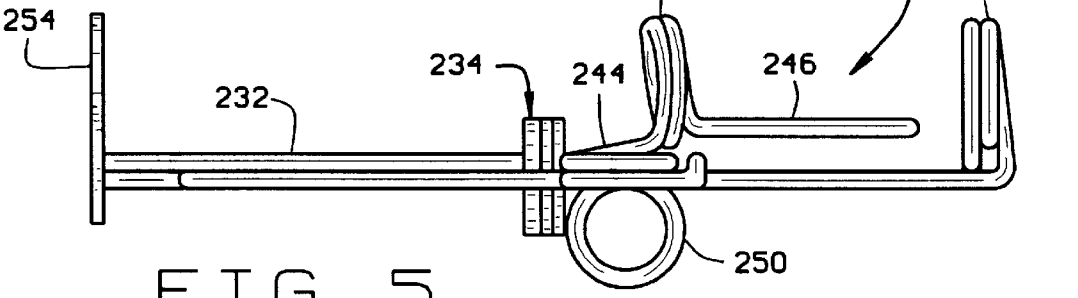
FIG. 5 is a side elevational view of the apparatus of FIG. 4.

An alternative embodiment of a mounting apparatus of the present invention is generally represented in FIGS. 4 and 5 by the reference numeral 230. This embodiment includes a "side-mount" frame 232 adapted for holding the flashlight 34 or other firearm accessory to one side of the barrel 42. The mounting apparatus 230 of this embodiment includes a lug fixture 234 fixed thereto. The lug fixture 234 is identical in structure and function to the lug fixture 54 described above. The frame 232 also includes a clamping mechanism 236 similar in structure and function to the clamping mechanism of the frame 50 discussed above. The clamping mechanism 236 includes a first flashlight-retaining member 240 and a second flashlight-retaining member 242.

Each of the first and second flashlight-retaining members 240 and 242 is configured to circumscribe the flashlight 34 or another firearm accessory. Preferably, the first flashlight-retaining member 240 is fixed relative to the frame 232. Preferably, the second flashlight-retaining member 242 is moveable relative to the first flashlight-retaining member 240 and relative to the frame 232 between a first position (shown in dashed lines in FIG. 4) and a second position (shown in solid lines in FIG. 4). The second flashlight-retaining member 242 is preferably connected to the frame 232 by a spring 244, which permits movement of the second flashlight-retaining member 242 between its first and second positions. Preferably, the spring 244 biases the second flashlight-retaining member 242 toward its second position. The clamping mechanism 236 of the frame 232 also preferably includes a lever 246 operatively connected to the second flashlight-retaining member 242 for moving the second flashlight-retaining member 242 from its second position toward its first position against the spring bias.

As best illustrated in FIG. 4, the first and second flashlight-retaining members 240 and 242 are generally in line with one another when the second flashlight-retaining member 242 is in its first position, and are off-set relative to one another when the second flashlight-retaining member 242 is in its second position. Thus, when the second flashlight-retaining member 242 is in its first position, the flashlight 34 or other accessory can be easily inserted through or removed from the first and second flashlight-retaining members 240 and 242. When the second flashlight-retaining member 242 is in its second position, the flashlight 34 or other accessory is securely held by the first and second flashlight-retaining members 240 and 242.

The frame 232 includes a resilient portion 250 between the clamping mechanism 236 and the lug fixture 234. The resilient portion 250 of the frame 232 is adapted for absorbing re-coil forces produced when the firearm 32 is fired. The resilient portion 250 is adapted to permit relative movement of the clamping mechanism 236 and the lug fixture 234, to thereby permit movement of the firearm 32 relative to the flashlight 34 (or other accessory being held by the clamping mechanism 236) when the frame 232 and the flashlight 34 are secured to the firearm 32. As shown in FIGS. 4 and 5, the resilient portion 250 is preferably a coil spring, although the resilient portion 250 could have other configurations that permit relative movement of the clamping mechanism 236 and the lug fixture 234. In certain low-recoil firearms, the resilient portion 250 will not be necessary. However, it has been found that, for high re-coil firearms, the resilient portion 250 helps to prevent damage to the flashlight 34 or other accessory as a result of the re-coil forces produced when the firearm is fired. The desired spring constant of the resilient portion 250, as well as the desired range of permissible movement between the clamping mechanism 236 and the lug fixture 234, can be chosen to suit the particular firearm with which the mounting apparatus 230 is being used.

Figure 19:
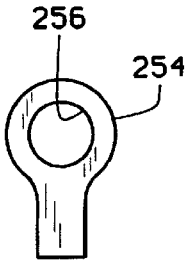
FIG. 19 is a fragmented end elevational view of a barrel-receiving fixture of the present invention.

The frame 232 also includes a barrel receiving fixture 254 positioned at a forward portion of the frame 232. FIG. 19 is a fragmented end elevational view of the barrel-receiving fixture 254. The barrel-receiving fixture 254 includes a hole 256 that is slightly larger in diameter than the muzzle or muzzle brake 46 of the firearm 32 to which the frame 232 is to be mounted. Similar to the barrel-receiving fixture 64 described above, the barrel-receiving fixture 254 of this embodiment fits over the muzzle or muzzle brake 46 when the frame 232 is mounted to the firearm 32.

Figure 20:
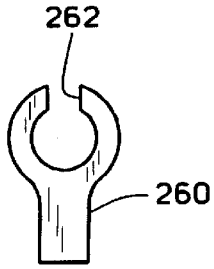
FIG. 20 is a fragmented end elevational view of an alternative embodiment of a barrel-receiving fixture of the present invention.

FIG. 20 is a fragmented end elevational view of another alternative embodiment of a barrel-receiving fixture 260. The barrel-receiving fixture 260 includes a notch 262. The notch is adapted for accommodating an aiming sight (not shown) of the barrel of a firearm, such as a rifle, when the barrel is received within the barrel-receiving fixture 260.

The mounting apparatus 30 shown in FIGS. 1–3 and the mounting apparatus 230 shown in FIGS. 4 and 5 are preferably formed from 3/16" 4140 alloy steel round stock that has been heat treated to a spring temper, although other suitable metal or non-metal materials could be used without departing from the scope of the present invention. As shown in FIGS. 1–3, the frame 50 is preferably formed by bending the round stock into the desired shape. The frame 50 may be formed from a single piece of round stock or from several pieces. Preferably, to improve the strength of the frame 50, certain portions may be fixed together such as by welding, although these portions of the frame 50 could be fixed together by other suitable means. The frame 232 shown in FIGS. 4 and 5 is preferably formed in the same way. Preferably, a "spray-on" rubber finish coating (not shown) is applied to the finished frame 50 (232). Preferably, the rubber coating coats the surfaces of the first and second flashlight-retaining members 60 (240) and 62 (242) and helps in retaining the flashlight 34 therein by "gripping" the exterior surface of the flashlight 34. Other types of coatings could be used, or no coating may be used, without departing from the scope of the present invention.

It should be understood that, although the mounting apparatus 30 and 230 shown in the drawings and described above are preferred, the particular construction and configuration of the mounting apparatus 30 and 230 are not critical, so long as the appropriate structural relationship of the lug fixture 54 (234) and clamping mechanism 58 (236) is present. For example, in lieu of alloy steel round stock, the frame could be formed of a monolithic piece of cast aluminum, or could be formed of several pieces operatively connected to one another, without departing from the scope of the present invention. Moreover, the dimensions and shape of the mounting apparatus 30 and 230 will vary depending on the firearm with which the apparatus is to be used. Each firearm will have different dimensions between the muzzle and the lug, different widths, heights, lengths, etc. The mounting apparatus 30 and 230 can be constructed with a configuration and dimensions that suit the particular firearm being used.

It should also be understood that the particular dimensions and shape of the lug 52 and lug fixture 54 may vary without departing from the scope of the present invention, so long as the above-described structural and functional relationship between the lug 52 and lug fixture 54 is present. In particular, the cross-section of the lug 52 and the cross-section of the channel 178 should match so that the lug 52 can be received within the lug fixture 54. Also, preferably, the lug fixture 54 is adapted to receive either the lug 52 of the present invention or a standard bayonet lug 70, but the lug 52 of the present invention is not receivable in a standard bayonet lug fixture 96.

In view of the above, it will be seen that the several objects of the invention are achieved and other advantageous results attained.

As various changes could be made without departing from the scope of the invention, it is intended that all matter contained in the above description or shown in the accompanying drawings shall be interpreted as illustrative and not in a limiting sense.

What is claimed is:

1. A firearm accessory mounting apparatus comprising:

a firearm;

an accessory;

a lug mounted to the firearm the lug having a cross-section including a generally horizontally extending lower lug portion with a generally horizontal bottom surface that extends from a leading edge of the lower lug portion toward a rear portion of the lower lug portion, the lug having a projection extending downwardly from the bottom surface of the lower lug portion, the projection extending from the leading edge of the lower lug portion toward the rear portion of the lower lug portion; and a frame having an accessory-holding portion adapted for holding the accessory, the frame including a lug fixture having a lug-receiving channel with a channel cross-section shaped and adapted to receive the lug in a manner for securing the frame to the firearm;

wherein said lug includes a recess, and wherein said lug fixture includes a locking mechanism with a moveable detent adapted for engaging the recess for releasably retaining the lug within the lug-receiving channel of the lug fixture.

2. The apparatus of claim 1 wherein the channel cross-section includes a generally horizontally extending lower channel portion with a generally horizontally extending bottom surface that extends from a leading edge of the lower channel portion to a rear portion of the lug receiving channel, the bottom surface of the lower channel portion being adapted for engagement with the bottom surface of the lower lug portion when the lug is received within the lug receiving channel, the bottom surface of the lower channel portion having a sub-channel extending from the leading edge of the lower channel portion toward the rear portion of the lug receiving channel, the sub-channel being shaped and adapted to receive the projection when the lug is received within the lug receiving channel.

3. The apparatus of claim 1 wherein the frame includes a resilient portion between the accessory-holding portion and the lug fixture, the resilient portion being adapted for absorbing re-coil forces produced when the firearm is fired.

4. The apparatus of claim 3 wherein the resilient portion is adapted to permit movement of the accessory-holding portion of the frame relative to the lug fixture, to thereby permit movement of the accessory relative to the firearm when the frame and the accessory are secured to the firearm.

5. The apparatus of claim 4 wherein the resilient portion of the frame is a coil spring.

6. The apparatus of claim 1 wherein the frame includes a barrel-receiving fixture forward of the lug fixture, the barrel-receiving fixture being adapted for receiving a forward end of a barrel of the firearm when the frame is secured to the firearm.

7. The apparatus of claim 6 wherein the barrel-receiving fixture includes a notch sized to accommodate an aiming sight of the barrel when the barrel is received within the barrel-receiving fixture.

8. The apparatus of claim 1 wherein the accessory-holding portion of the frame includes a first accessory-retaining member and a second accessory-retaining member spaced from the first accessory-retaining member, at least a portion of the first accessory-retaining member lying in a first plane and at least a portion of the second accessory-retaining member lying in a second plane, the second accessory-retaining member being moveable relative to the first accessory-retaining member between first and second positions, the first and second planes being substantially parallel with one another when the second accessory-retaining member is in its first position and being non-parallel when the second accessory-retaining member is in its second position, the second accessory-retaining member being connected to the frame by a resilient member which permits movement of the second accessory-retaining member between its first and second positions, the resilient member biasing the second accessory-retaining member toward its second position, the first and second accessory-retaining members being adapted for permitting engagement and disengagement of the accessory with the first and second accessory-retaining members when the second accessory-retaining member is in its first position and for securing the accessory relative to the first and second accessory-retaining members when the second accessory-retaining member is in its second position.

9. The apparatus of claim 8 further comprising a lever operatively connected to the second accessory-retaining member for moving the second accessory-retaining member between its first and second positions.

10. A firearm accessory mounting apparatus comprising:

a firearm having a lug with a cross-section including a generally horizontally extending lower lug portion, the lower lug portion having a generally horizontally extending bottom surface that extends from a leading edge of the lower lug portion to a rear portion of the lower lug portion, the lug having a projection extending downwardly from the bottom surface of the lower lug portion, the projection extending from the leading edge of the lower lug portion toward the rear portion of the lower lug portion;

an accessory;

a firearm having an accessory-holding portion adapted for holding the accessory; and a lug fixture connected to the frame, the lug fixture having a lug-receiving channel with a channel cross-section shaped and adapted to receive the lug of the firearm in a manner for securing the frame and the accessory to the firearm when the lug is received within the lug receiving channel;

wherein the frame includes a resilient portion between the accessory-holding portion and the lug fixture, the resilient portion being adapted for absorbing re-coil forces produced when the firearm is fired.

11. The apparatus of claim 10 wherein the resilient portion is adapted to permit movement of the accessory-holding portion of the frame relative to the lug fixture, to thereby permit movement of the accessory relative to the firearm when the frame and the accessory are secured to the firearm.

12. The apparatus of claim 11 wherein the resilient portion of the frame is a coil spring.

13. The apparatus of claim 10 wherein the frame includes a barrel-receiving fixture forward of the lug fixture, the barrel-receiving fixture being adapted to at least partially circumscribe a forward end of a barrel of the firearm when the frame is secured to the firearm.

14. A firearm accessory mounting apparatus comprising:

a firearm;

an accessory;

a frame mounted to the firearm;

a first accessory-retaining member connected to the frame, at least a portion of the first accessory-retaining member lying in a first plane; and a second accessory-retaining member spaced from the first accessory-retaining member, at least a portion of the second accessory-retaining member lying in a second plane, the second accessory-retaining member being moveable relative to the first accessory-retaining member between first and second positions, the first and second planes being substantially parallel with one another when the second accessory-retaining member is in its first position and being non-parallel when the second accessory-retaining member is in its second position, the second accessory-retaining member being connected to lie frame by a resilient member which permits movement of the second accessory-retaining member between its first and second positions, the resilient member biasing the second accessory-retaining member toward its second position;

wherein the first and second accessory-retaining members are adapted for permitting engagement and disengagement of the accessory with the first and second accessory-retaining members when the second accessory-retaining member is in its first position and for securing the accessory relative to the first and second accessory-retaining members when the second accessory-retaining member is in its second position.

15. The apparatus of claim 14 further comprising a lever operatively connected to the second accessory-retaining member for moving the second accessory-retaining member between its first and second positions.

16. The apparatus of claim 14 further comprising a lug mounted to the firearm, the frame including a lug fixture having a lug-receiving channel adapted to receive the lug in a manner for securing the frame and the accessory to the firearm.

* * * * *